US005887521A

United States Patent [19]

Nakamura et al.

[11] Patent Number: 5,887,521

[45] Date of Patent: Mar. 30, 1999

[54] DAMPENING WATER SUPPLY DEVICE

[75] Inventors: Daisuke Nakamura, Yokohama; Hideo Kawamori, Mitaka, both of Japan

[73] Assignee: Kabushiki Kaisha Tokyo Kikai Seisakusho, Tokyo, Japan

[21] Appl. No.: 62,486

[22] Filed: Apr. 17, 1998

[30] Foreign Application Priority Data

Jul. 11, 1997 [JP] Japan ..... 9-186377

[51] Int. Cl.[6] ..... B41F 7/30; B41F 31/08

[52] U.S. Cl. ..... 101/147; 101/366

[58] Field of Search ..... 101/366, 147, 101/148, 365

[56] References Cited

U.S. PATENT DOCUMENTS

| | | | |
|---|---|---|---|
| 4,649,818 | 3/1987 | Switall et al. | 101/148 |
| 4,892,035 | 1/1990 | Terzuolo | 101/147 |
| 5,398,605 | 3/1995 | Tokiwa | 101/366 |

FOREIGN PATENT DOCUMENTS

| | | |
|---|---|---|
| 52-152309 | 12/1977 | Japan . |
| 2-19229 | 5/1990 | Japan . |

*Primary Examiner*—J. Reed Fisher

*Attorney, Agent, or Firm*—Frishauf, Holtz, Goodman, Langer & Chick

[57] ABSTRACT

A dampening water supply device is capable of reducing spoilage upon initiation of printing after temporary stop when accumulated printing operation before temporary stop is large. The spray type dampening water supply device includes actuation signal output means for outputting an actuation signal corresponding to rotating operation of a rotary portion associated with operation of the printing press, counting means for counting a signal output from the actuation signal output means and outputting a signal at every predetermined number of count, nozzle operation control means set a plurality of control modes determined for differentiating supply amount of the dampening water from initiation of printing to a predetermined operating condition, for controlling operation of the nozzle means, control mode designating means for selectively designating the control mode of the nozzle operation control means at every occurrence of temporary stop and initiation of printing of operation of the printing press corresponding to an accumulated count value on the basis of the signal output from the counting means. Upon initiation of printing after temporary stop, the supply amount of the supply amount of the dampening water from initiation of printing up to a predetermined printing condition, is greater than a necessary amount for normal printing.

1 Claim, 2 Drawing Sheets

DAMPENING WATER SUPPLY DEVICE

BACKGROUND OF THE INVENTION

1. Field of the Invention

The present invention relates to a dampening water supply device in an offset printing press, and relates to a spray type dampening water supply device employing a spray nozzle. More specifically, the invention relates to a dampening water supply device which can supply dampening water in an amount exceeding a necessary amount in normal printing.

2. Description of the Related Art

In the recent years, a large number of proposals have been presented for spray type dampening water supply devices in an offset printing press for improvement of precision of a spray nozzle, no contamination of the dampening water by an ink and easiness and relatively high precision of control of a supply amount. On the other hand, as disclosed in Japanese Unexamined Patent Publication No. 52-152309, for example, it has been well known that dampening water in an amount. exceeding a necessary amount in normal printing has to be supplied in order to suppress occurrence of spoilage upon starting of a printing operation.

On the other hand, in Japanese Examined Utility Model Publication No. 2-19229, there has been disclosed a dampening water supply device which can supply the dampening water in an amount exceeding a necessary amount in the normal printing.

The dampening water supply device disclosed in the latter publication is provided with an electric-pneumatic converter performing electric-pneumatic conversion by an electric signal from speed detecting means of a rotary press to vary an air pressure in a water stage vessel connected to a spray nozzle adapting to variation of motion speed of a printing press so that supply of dampening water adapting to the motion speed of the printing press becomes possible. Furthermore, as another control current source for the electric-pneumatic converter, a constant current circuit is provided for performing electric-pneumatic conversion by a constant current for applying a desired air pressure to the water storage vessel for supplying a large amount of the dampening water upon initiation of printing operation.

On the other hand, in the printing operation, it is possible to temporarily stop the printing press in certain cases. For example, in newspaper printing, it is possible to vary a content of news, such as to include more detailed information or so forth, as time goes by, and/or to provide a page having news adapting to local delivery areas. Whenever printing of a predetermined volume is completed, the printing press is temporarily stopped to exchange the relevant plates. Particularly, in recent newspaper printing operations, plates are exchanged at high frequency in order to satisfy readers' demands by providing fresh information and information relevant to the readers as much as possible.

It has been recognized and considered to be a problem that if the dampening water is supplied in the completely same manner as at the initial starting of the printing operation whenever printing is resumed after a temporary stop for exchanging of the plate or so forth, the amount of spoilage to be caused upon resumption of the printing after the temporary stop can be greater after a greater accumulated period of printing operation before temporary stop.

While the true cause is not clear, it has been considered that according to increasing of accumulated period of the printing operation, the temperature of the ink and the plate rises and the hydrophilic property of the non-image portion is lowered due to wearing of the plate and so forth are combined reasons to make the ink to be easily deposited on the non-image portion of the plate.

SUMMARY OF THE INVENTION

The present invention has been worked out for solving such a problem. Therefore, it is an object of the present invention to avoid increasing of spoilage to be generated upon resumption of the printing after a temporary stop after a relatively long accumulated period of printing operation before temporary stop, and whereby to reduce a loss by spoilage and to improve efficiency of the printing operation.

In order to accomplish the above-mentioned object, according to one aspect of the present invention, a dampening water supply device has a nozzle means having a nozzle for spraying a dampening water supplied from a dampening water source and controlling spraying and stopping of the dampening water from the nozzle according to a predetermined control mode associated with operating condition of a printing press for varying a supply amount of the dampening water to be supplied by the nozzle means depending upon operating condition of the printing press. The device comprises:

- actuation signal output means for outputting an actuation signal corresponding to rotating operation of a rotary portion associated with operation of the printing press;
- counting means for counting a signal output from the actuation signal output means and outputting a signal at every predetermined number of counted actuation signals;
- nozzle operation control means having a plurality of control modes for differentiating a supply amount of the dampening water from initiation of printing to a predetermined operating condition; and
- control mode designating means for selectively designating the control mode of the nozzle operation control means at every occurrence of a temporary stop and initiation of printing by the printing press corresponding to an accumulated count value on the basis of the signal output from the counting means;

wherein spraying and stopping of the dampening water from the nozzle is controlled according to the control mode designated by the control mode designating means upon initiation of printing after each temporary stop so that the supply amount of the dampening water from initiation of printing up to a predetermined printing condition is greater than a necessary amount for normal printing.

In response to the dampening water supply device operation ON signal, the counting means and the nozzle operation control means are set to an operative state. Upon initiation of operation of the printing press, the dampening water is sprayed from the nozzle of the nozzle means by operation control of the nozzle operation control means.

Then, at this time, the actuation signal corresponding to rotating operation of the rotary portion associated with operation of the printing press is input to the counting means from the actuation signal output means. In this counting means, a count signal is output per every predetermined number of counted actuation signals. Then, on the basis of the signal from the counting means, the control mode corresponding to the accumulated count value is selectively designated at every occurrence of a temporary stop and initiation of printing of the printing press. By this, upon initiation of printing after a temporary stop of the printing press, the supply amount of the damping water is set to be slightly greater than that required upon normal printing, corresponding to the length of the period of the accumulated printing operation before the temporary stop.

BRIEF DESCRIPTION OF THE DRAWINGS

The present invention will be understood more fully from the detailed description given here below and from the accompanying drawings of the preferred embodiment of the invention, which, however, should not be taken to be limitative to the present invention, but are for explanation and understanding only.

In the drawings

DESCRIPTION OF THE PREFERRED EMBODIMENT

In the following description, numerous specific details are set forth in order to provide a thorough understanding of the present invention. It will be obvious, however, to those skilled in the art that the present invention may be practiced without these specific details. In other instances, well-known structures are not shown in detail in order to avoid unnecessarily obscuring the present invention.

Figure 1:
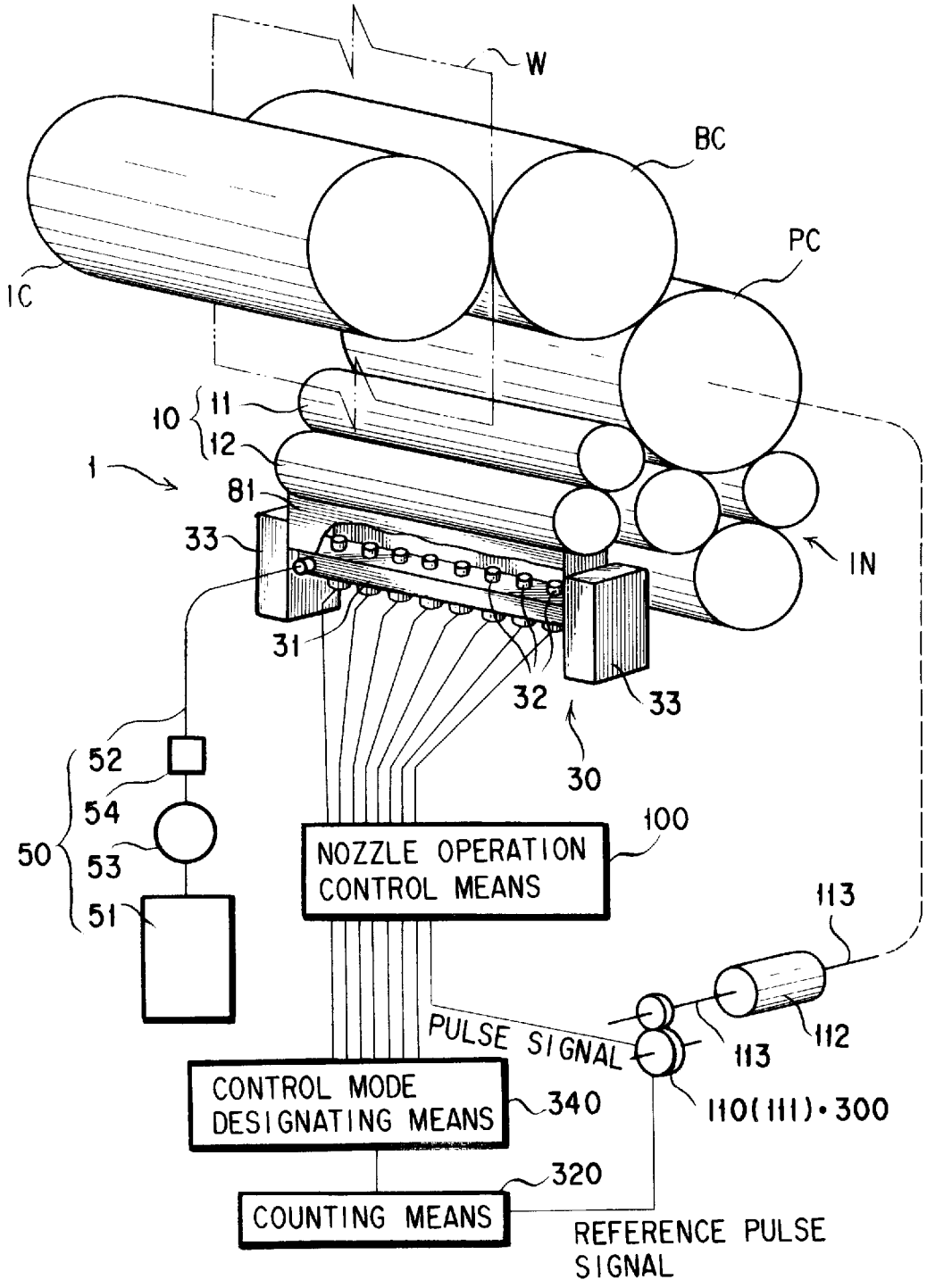
FIG. 1 is a perspective view showing a general construction of a planographic printing press having one embodiment of a dampening water unit according to the present invention.

In a planographic printing press having the preferred embodiment of a dampening water supply device 1 shown in FIG. 1, a plate (not shown) formed with providing hydrophobic property for an image portion and hydrophilic property for a non-image portion, is set on a plate cylinder PC. On the surface of the plate, an appropriate amount of ink is supplied by an inking unit IN (in FIG. 1, the inking unit is illustrated with neglecting an upstream side), and an appropriate amount of dampening water is supplied by a dampening water supply device 1.

As a result, utilizing ambivalent properties of the image portion and non-image portion of the surface of the plate, and mutually repulsive properties of a water base dampening water and an oil-base ink, the ink is deposited only on the image portion to print an image on a web W threaded between a blanket cylinder BC and an impression cylinder IC via a surface of a blanket (not shown) set on the blanket cylinder BC.

The dampening water supply device 1 include roller means 10 having a contact portion contacting with the plate, nozzle means 30 spraying the dampening water toward a predetermined portion as required, and dampening water resupplying means 50 for resupplying the dampening water to the nozzle means 30.

The roller means 10 is constructed with a downstream roller 11 contacting with the plate to rotate therewith, and an upstream roller 12 contacting with the downstream roller 11 to rotate therewith and receiving the dampening water sprayed from the nozzle means 30. The downstream roller 11 and the upstream roller 12 are provided in contact with each other, in parallel relationship with each other.

While the shown roller means 10 is constructed with two rollers, i.e. the downstream roller 11 and the upstream roller 12, but can be constructed by neglecting the downstream roller 11 and to directly contacting the upstream roller 12 with the plate. In the alternative, it is possible to construct the roller means 10 by adding other rollers, such as a rider roller (not shown), an intermediate roller (not shown) and so forth. Furthermore, it is possible to construct the roller means 10 so that the dampening water is received on the outer peripheral surfaces of a plurality of rollers at a position in the vicinity of the contact portion of adjacent rollers.

The nozzle means 30 includes a tube member 31 provided in substantially parallel relationship with an axis of the upstream roller 12, a plurality of nozzles 32 . . . (eight in the shown embodiment) mounting on the tube member 31 at substantially regular intervals. Both sides of the longitudinal direction of the nozzle means are mounted on a frame (not shown) via a bracket 33. On the tube member 31, the dampening water is resupplied under pressure from the dampening water resupplying means 50 connected thereto, in a manner set out later.

The nozzles 32 . . . have spraying openings spraying the dampening water toward the outer peripheral surface of the upstream roller 12. Intake openings of the nozzles 32 . . . for introducing the dampening water are opening to the tube member 31. The spraying openings of the nozzles 32, . . . are directed toward the outer peripheral surface of the upstream roller 12.

For each nozzle 32, an electromagnetic valve mechanism (not shown) is provided for controlling supply amount of the dampening water from the nozzle 32 by opening and closing the spraying opening by energizing the electromagnetic valve mechanism to open the spraying opening and de-energizing the electromagnetic valve mechanism to close the spraying opening by a force of a spring (not shown).

The dampening water resupplying means 50 includes a dampening water vessel 51 storing the dampening water, a passage 52 connecting the dampening water vessel 51 and the tube member 31, and a pump 53 disposed within the passage 52. Also, pressure regulating means 54 is provided on the downstream side of the pump 53 in the passage 52. At least in the vicinity of a coupling portion with the tube member 31, the passage 52 is preferably formed of a flexible tube member so as to facilitate adjustment of mounting position and maintenance.

Nozzle operation control means 100 is electrically associated with a speed signal output means 110 outputting a signal corresponding to an operation speed of a printing press. The speed signal output means 110 is constructed with a pulse signal outputting mechanism 111, such as a rotary encoder or the like, provided in association with a rotary portion rotating together with or in synchronism with the plate cylinder PC, such as a main drive shaft 113 driven to rotate by a primary driving source 112, and outputting a pulse signal synchronously with rotation of the plate cylinder PC.

The nozzle operation control means 100 is connected to the pulse signal output mechanism 111 for inputting the pulse signal to count the pulse signal to output an excitation current for solenoids of the nozzles 32 . . . whenever the counted value reaches a predetermined set value and to maintain the excitation current for a predetermined set period corresponding to the counted value of the pulse within a given period, namely corresponding to an operation speed of the printing press. In practice, the nozzle operation control means includes a CPU and solenoid drivers.

Output modes of the excitation signals for outputting excitation current to the not shown solenoid driver of the nozzle operation control means 100 (namely, control modes of the nozzles 32 . . . ) are set as shown by the following tables 1 to 3, for example, for outputting the excitation signal of the output mode selected and designated by control mode designating means 340. It should be appreciated that the following tables 1 to 3 exemplify output modes of the excitation signal in newspaper printing. In the table, the printing speed represents number of volumes of printing of newspaper per one hour (one volume is one sheet of paper corresponding to two pages of the normal size newspaper).

TABLE 1

(Standard Control Mode)

| Output Interval | Per Every 2000 Count of Pulse Signal | | | | | | | | |
|---|---|---|---|---|---|---|---|---|---|
| Printing Speed (ten thousands/hour | <2 | <4 | <6 | <8 | <10 | <12 | <14 | <16 | 16≦ |
| Output Maintaining Period (second) | 0.070 | 0.066 | 0.062 | 0.058 | 0.054 | 0.050 | 0.046 | 0.042 | 0.038 |

TABLE 2

(Control Mode Upon Start Printing)

| Control Mode Number | Output Interval Output Speed (ten thousands/hour) Accumulated Count of Actuation signal | | Per 2000 Counts of Pulse Signals <2 | <4 |
|---|---|---|---|---|
| 01 | <A | Output Maintaining Period | 0.075 | 0.071 |
| 02 | <B | | 0.080 | 0.076 |
| 03 | <C | | 0.085 | 0.081 |
| 04 | <D | | 0.088 | 0.084 |
| 05 | <E | | 0.091 | 0.087 |
| 06 | <F | | 0.094 | 0.090 |
| 07 | F≦ | | 0.096 | 0.092 |

TABLE 3

(Control Mode Upon Starting Printing)

| Control Mode Number | Output Maintaining Period (S) Printing Speed (Ten Thousands/Hour) Accumulated Count of Actuation signal | | 0.070 <2 | 0.066 <4 |
|---|---|---|---|---|
| 01' | <A | Output Interval (Counted Number of Pulse Signal) | 1920 | |
| 02' | <B | | 1860 | |
| 03' | <C | | 1800 | |
| 04' | <D | | 1740 | |
| 05' | <E | | 1700 | |
| 06' | <F | | 1660 | |
| 07' | F≦ | | 1640 | |

In the foregoing table 1, there is exemplary shown set values determined as output modes of the excitation signal for supplying the dampening water required for normal printing, in which the output maintaining periods of the excitation signal are set to be 70/1000 to 38/1000 seconds depending upon the printing speed so that the excitation signal is output at every 2000 counts of the output pulses of the pulse signal output mechanism 111.

The table 2 exemplary shows an output mode of the excitation signal for supplying dampening water in an amount exceeding a necessary amount for normal printing, namely set values for determining control modes upon a start of printing, similarly to the table 1. The output interval of the excitation signal is the interval for counting 2000 of the output pulses of the pulse signal output mechanism 111, setting of which is the same as that of the table 1. Then, the output maintaining period of the excitation signal depending upon the printing speed is set to be longer than those of setting in the table 1. Also, seven mutually distinct output maintaining periods are set corresponding to accumulated count value of the actuation signal to be output by the actuation signal out means 300 which will be discussed later (in the shown embodiment, a reference pulse signal output from the pulse signal output mechanism 111 which will be discussed later, is utilized as replacement), for example.

In the table, A to F are accumulated count values of the actuation signals, namely reference pulse signals in the shown embodiment, and are the values from 30000 to 180000 with a step of 30000.

The table 3 exemplary shows set values setting the output modes (control modes upon starting printing) of the excitation signal for supplying the dampening water in an amount exceeding the amount required for normal printing, up to reaching the printing speed of 40000 volumes per hour from intitiation of the printing, similarly to the table 2. The setting in the table 3 is differentiated from the table 2 in that while the table 2 defines the output interval of the excitation signal, namely to make the number of output pulses of the pulse signal output mechanism 111 constant, the table 3 defines the output modes in which the output maintaining period of the excitation signal is set to be constant, and the number of output pulses of the pulse signal output mechanism 111 determining the output interval of the excitation signal is reduced, namely the reduced output interval of the excitation signal.

In the alternative, while it is not shown in the table, it is possible to take the output mode of the excitation signal, in which the output maintaining period of the excitation signal is set to be longer and the output interval of the excitation signal is reduced.

On the other hand, the nozzle operation control means 100 is set correction coefficients of 1/1000 to 10/1000 seconds for correcting the output maintaining period of the excitation signal, for example, so that slight correction of the supply amount of the dampening water per each nozzle 32 . . . . The correction coefficient enables preliminary correction of the output maintaining period of the excitation signal by an external correction command.

The actuation signal output means 300 is designed to output one signal per one cycle of rotation of the rotary portion, for example, corresponding to rotating operation of the rotary portion associated with operation of the printing press, so that signal can be output corresponding to operation of the printing press. In the shown embodiment, the pulse output mechanism 111 is provided the reference pulse output function for outputting the reference pulse signal per predetermined number of pulse output. Then, the reference pulse signal and the pulse output mechanism 111 are used as replacement for the actuation signal and the actuation signal output means 300. Of course, it is possible to separately provide the actuation signal output means (not shown) associated with the plate cylinder PC, for example, without using the pulse output mechanism 111 as a replacement.

Figure 2:
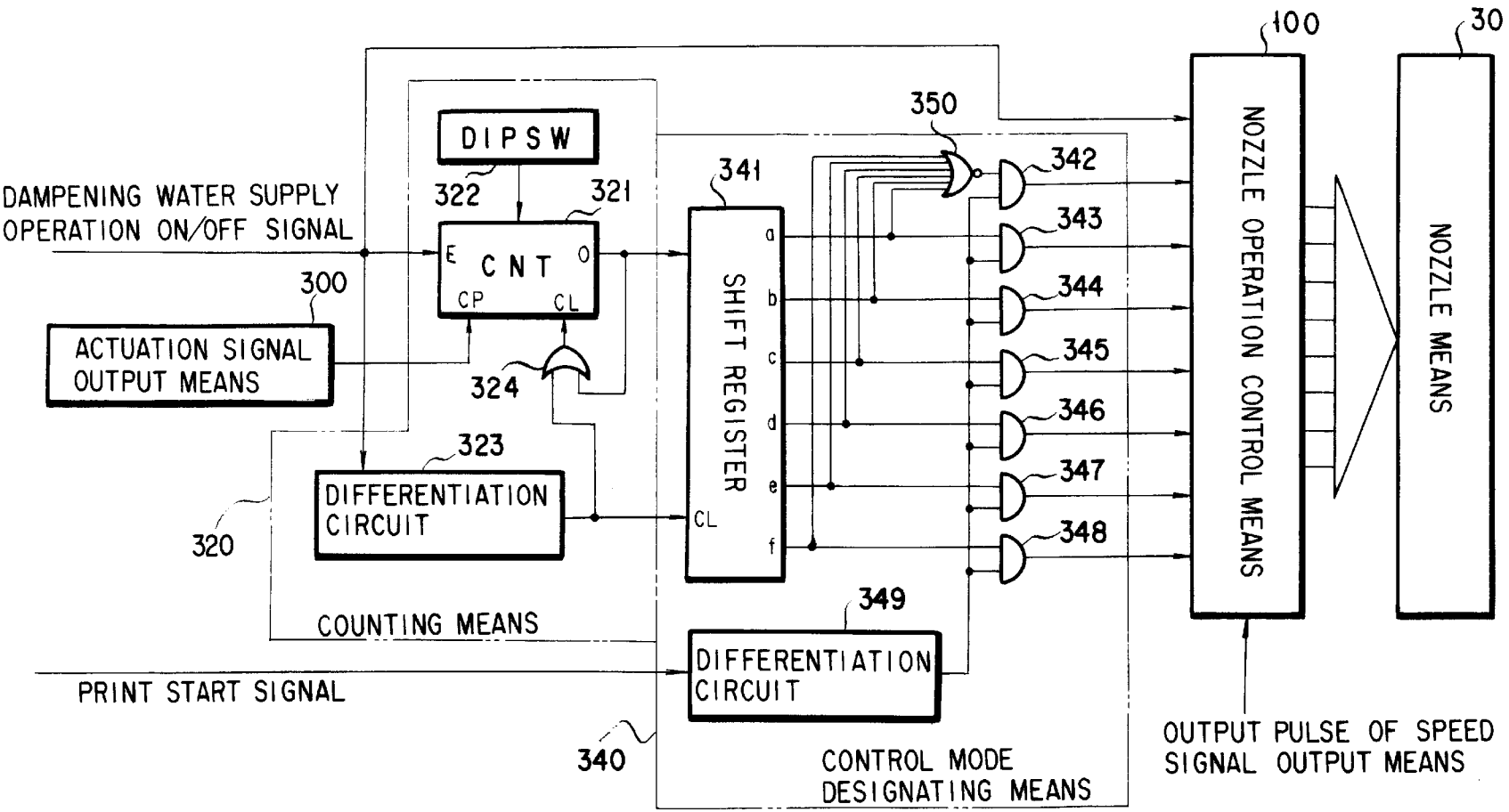
FIG. 2 is a block diagram showing one embodiment showing a construction of a control system of the dampening water unit according to the present invention.

Counting means 320 is adapted to count the actuation signal output from the actuation signal output means 300 and to output a count stop signal whenever counting of a predetermined number is completed. In the embodiment shown in FIG. 2, the counting means 320 includes a counter 321 counting the actuation signal and outputting the count stop signal whenever counting up to the predetermined number is completed, a dip switch 322 for setting the predetermined number to be counted by the counter 321 and a differentiation circuit 323 outputting a differentiated signal in response to rising and falling edges of operation ON/OFF signal indicative of active and inactive states of the dampening water supply device.

Control mode designating means 340 includes a shift register 341 sequentially shifting outputs at every input of the count stop signal output by the counter 321 of the counting means 320, a plurality of (seven in the shown embodiment) AND circuit 342 to 348 provided so that any one of the AND circuits 342 to 348 is selectively turned ON to output a signal depending upon a combination of the output signal of the shift register 341 and a print start signal of the printing press, and a differentiation circuit 349 for outputting a differentiated signal corresponding to rising of each printing start signal.

Next, operation of the dampening water supply device 1 constructed as set forth above, will be discussed.

In response to the operation ON signal indicative of active state of the dampening water supply device, the dampening water stored in the dampening water vessel 51 is resupplied to the tube member 31 via the passage 52 by the pump 53. On the other hand, the operation ON signal is input to the counting means 320 and the nozzle operation control means 100 to place these two means in active state.

The dampening water resupplied to the tube member 31 is sprayed toward predetermined portion on the outer peripheral surface of the upstream roller 12 of the roller means 10 which has a contact portion with the plate cylinder from the nozzles 32 . . . only when the electromagnetic valve mechanisms of the nozzles 32 . . . are opened by operation control of the nozzle operation control means 100 which will be discussed later. Then, remaining dampening water fallen down from the outer peripheral surface of the upstream roller 12 or so forth is drained from a not shown drain opening provided in a cover 81 or so forth and thus returned to the dampening water vessel 51.

On the other hand, separately from the operation ON signal indicative of the dampening water supply device, a print start signal is output.

Then, the primary driving source 112 initiates rotating driving to whereby rotatingly drive the plate cylinder PC via the main drive shaft 113. Also, the pulse signal output mechanism 111 outputs 250 pulse signals per one cycle of rotation of the main drive shaft 113, for example corresponding to rotation of the main drive shaft 113. The pulse signal output mechanism 111 also outputs one reference pulse signal every time outputting the predetermined number of the pulse signal (e.g. 1000) in the shown embodiment.

The output signal output from the pulse signal output mechanism 111 is input to the nozzle operation control means 100. On the other hand, the reference pulse signal output from the pulse signal output mechanism 111 is input to the counting means 320 as a replacement signal of the operation signal, as set forth above.

On the other hand, when the printing start signal is output, the printing start signal is converted into a differentiated signal by the differentiation circuit 349 of the control mode designating means 340. The differentiated signal is input to the AND circuits 342 to 348. One of the AND circuits 342 to 348 selected depending upon the signal output condition of the shift register 341 outputs the control mode designating signal to selectively designate one of the control modes, namely the output mode of the excitation signal, set in the nozzle operation control means 100.

Namely, when the first printing signal is output, respective signal output terminals of the shift register 341 do not output the signal yet. Then, the AND circuit 342 which is connected to respective signal output terminals of the shift register 341 via a NOR circuit 350, outputs the control mode designation signal. When the control modes shown in the tables 1 and 2 are set in the nozzle operation control means 100, the control mode of the table 1 and number 01 is designated by the output of the AND circuit 342. It should be appreciated that the control mode shown in the table 1 is the same as a standard control mode and is always designated by the control mode designation signal output by any one of the AND circuits 342 to 348.

In such conditions, when the pulse signal output from the pulse output mechanism 111 is input to the nozzle operation control means 100, the pulse signal is counted in the nozzle operation control means 100. Whenever the counted value reaches a predetermined set value, e.g. "2000", namely at every predetermined angle of rotation of the plate cylinder, the excitation signal for the solenoid driver is continuously output for a predetermined set period, namely for a set period corresponding to the current printing speed at the relevant timing. Only under the condition where the printing speed is less than or equal to 40000 volumes per hour upon initiation of printing, the control mode upon initiation of printing as shown in the table 2 is given in preference to the standard control mode shown in the table 1.

When the output mode of these excitation signal is preliminarily provided the correction command for performing supply of the dampening water with varying conditions for each nozzles 32, . . . depending upon proportion and arrangement of scanning of the plate. Outputting of the excitation signal is performed by a corrected output maintaining period.

When the excitation signal is output, the solenoid driver applies the excitation current to the solenoid of the electromagnetic valve mechanisms of the nozzles 32, . . . according to the excitation signal to open the valve. As a result, for the predetermined portion on the outer peripheral surface of the upstream roller 12, the dampening water is sprayed in the supply amount according to the preliminarily set condition.

Namely, when the print start signal is output, the control mode designating means 340 designates the control mode of the nozzles 32, . . . by the nozzle operation control means 100. In conjunction therewith, by a sequential control triggered by the print start signal, the printing press is operated and accelerated. Then, whenever the number of pulse signals output from the pulse signal output mechanism 111 reach the predetermined number, e.g. "2000", the nozzles 32, . . . are opened for the set period corresponding to the instantaneous printing speed at that timing for spraying the dampening water. In supply of the dampening water, in a period from initiation of the printing to the timing at which the printing speed reaches 40000 volumes per hour, the period to open the nozzles 32, . . . is set to be slightly longer than that in the standard control mode so that the supply amount of the dampening water is in excess of the necessary amount in normal printing. Subsequently, normal printing is performed until printing is stopped responsive to a stop signal. During this period, opening of the nozzles 32, . . . is performed by a standard control mode so that the supply amount of the dampening water becomes the amount necessary for normal printing.

It should be noted that when the control mode shown in the table 3 is set in the nozzle operation control means 100 in place of the control mode of the table 2, control of opening of the nozzles 32, . . . during the period from initiation of printing to the timing where the printing speed reaches 40000 volumes per hour, is performed by the control mode shown in the table 3.

The dampening water supplied to the upstream roller by opening of the nozzles 32, . . . , is leveled upon passing through the contact portion between the upstream roller 12 and the downstream roller 11 by the rolling operation of the roller means 10, is transferred to the downstream roller 11 and then transferred to the plate via the downstream roller 11.

To the plate, an ink is separately supplied by the inking unit IN. By mutual repulsive property of the hydrophilic dampening water transferred to the non-image portion and the hydrophobic ink, the ink is transferred only to the image portion. The ink of the scanning portion is printed on the web W via the blanket surface of the blanket cylinder BC.

On the other hand, in the counting means 320 placed in operative state by the dampening water operation ON signal, at first, the predetermined value is set in the counter 321 by the dip switch 322, for example "300000". Also, the dampening water supply device operation ON signal is converted into the differentiated signal by the differentiation circuit 323 to be output. The differentiation signal is input to the counter 321 via the OR circuit 324 to reset the counted value of the counter 321.

On the other hand, the differentiated signal resets the shift register 341 of the control mode designating means 340 which will be discussed later.

In such conditions, when the print start signal (the first print start signal) is output, the control mode designating means 340 designates the control mode set in the nozzle operation control means 100 as set forth above. Also, the primary driving source 112 is rotatingly driven to start printing operation of the printing press. In conjunction therewith, the pulse signal output mechanism 111 outputs the reference pulse signal as a replacement signal of the actuation signal.

The reference pulse signal is input to the counter 321 and counted by the counter 321. The counter 321 outputs a set value counting completion signal every time that the counted value reaches the set value set by the dip switch 322.

The set value counting completion signal is input to the shift register 341 of the control mode designating means 340 and resets the counted value of the counter 321 via the OR circuit 324. The counter 321 sequentially repeats counting of the reference pulse signal and outputting of the set value counting completion signal.

The shift register 341 is responsive to the input set value counting completion signal output from the counter 321, signal is output from one of the output terminals. Whenever sequentially inputting the set value counting completion signal from the counter, the output terminal to output the signal is shifted in sequential order from the output terminal a to the output terminal f, in the shown embodiment, for example.

The output signal output from the shift register 341 is input to any one of the AND circuit 343 to 348 separately provided corresponding to respective output terminals a to f.

Here, at a timing where 65000 reference pulse signals (namely actuation signals) are output, the printing operation is interrupted for exchanging the plate. During a period from initiation of printing to interruption, the counter 321 counts the reference pulse signals (namely actuation signal) to reach the set value, e.g. 30000, set by the dip switch 322 twice, to output the set value counting completion signal twice. The counter 321 is maintained in the condition where the reference pulse signal (namely, the actuation signal) is counted to 5000.

On the other hand, the set value counting completion signal is input to the shift register 341 twice. Thus, the shift register 341 is maintained in the condition where the output signal b is outputting the signal to the AND circuit 344.

Under these conditions, when the print start signal is output for resuming printing after completion of exchanging of the plate, the print start signal is converted into the differentiated signal by the differentiation circuit 349 of the control mode designating means 340 to be output and to be input to the respective AND circuits 342 to 348. Then, the AND circuit 344, in which AND condition of the output signal of the shift register 341 and the differentiated signal is established, outputs the control mode designation signal to designate the standard control mode shown in the table 1 and the control mode for initiation of printing of the control mode number 03 of the table 2.

On the other hand, by the sequential control triggered by the printing start signal for resuming printing, the printing press is operated and accelerated. Then, the printing press performs a printing operation similarly to the foregoing, but only the control mode of the dampening water supply up to reaching the printing speed of 40000 volumes per hour from initiation of printing is modified to use the control mode shown by the control mode number 03 of the table 2.

Subsequently, when printing is interrupted by the stop signal, whenever the print start signal is output for resuming printing, the control mode of dampening water supply is selectively designated by the control mode designating means 340 similarly to the above, and printing operation of the printing press is performed. By the dampening water supply device operation OFF signal output after completion of printing up to the scheduled volume, all of the operation of the dampening water supply device is stopped.

It should be noted that where a counter-etching of the plate should be performed upon starting the printing operation, the control mode of supply of the dampening water on the initiation of printing to be set in the nozzle operation control means 100 may be set to the control mode including the dampening water supply for counter-etching.

On the other hand, the accumulated counted value of the reference pulse signal (namely, the actuation signal) to be a reference upon designating the control mode may be set arbitrarily depending upon the practical operating condition.

Furthermore, all or part of functions corresponding to the counting means 320 and the control mode designating means 340 may be performed by CPU as a part of the nozzle operation control means 100 or CPU provided separately.

As set forth above, upon starting printing after temporarily stopping the printing press, such as for exchange of plate in the newspaper printing, the supply amount of the dampening water is set to be a slightly greater amount than that required for normal printing corresponding to accumulated printing operation up to the temporary stop to eliminate deposition of ink on the non-printing portion of the plate in a short period, so that occurrence of spoilage can be reduced in comparison with the prior art. Thus, loss to be caused by the spoilage can be reduced to improve operation efficiency of the printing press.

Although the invention has been illustrated and described with respect to an exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

What is claimed is:

1. A dampening water supply device comprising:

a nozzle for spraying dampening water supplied from a dampening water source;

actuation signal output means for outputting an actuation signal corresponding to a rotating operation of a rotary portion of a printing press;

counting means for counting the actuation signals output by said actuation signal output means and for outputting a count signal every predetermined number of counted actuation signals;

nozzle operation control means having a plurality of control modes for differentiating the supply amount of the dampening water to be supplied to said nozzle; and control mode designating means for selectively designating the control mode of said nozzle operation control means at every occurrence of a temporary stop and an initiation of printing by said printing press in accordance with an accumulated count value of the count signals output by said counting means;

wherein spraying and stopping of the dampening water from the nozzle is controlled according to the control mode designated by said control mode designating means upon initiation of printing after each temporary stop so that the supply amount of the dampening water from initiation of printing up to a predetermined printing condition is greater than a necessary amount for normal printing.

* * * * *